United States Patent [19]

Feldman

[11] 4,211,534

[45] Jul. 8, 1980

[54] COMBINATION OF ETHYLENE POLYMER, POLYMER HAVING ALKYL SIDE CHAINS, AND NITROGEN CONTAINING COMPOUND TO IMPROVE COLD FLOW PROPERTIES OF DISTILLATE FUEL OILS

[75] Inventor: Nicholas Feldman, Woodbridge, N.J.

[73] Assignee: Exxon Research & Engineering Co., Florham Park, N.J.

[21] Appl. No.: 938,050

[22] Filed: Aug. 30, 1978

Related U.S. Application Data

[63] Continuation-in-part of Ser. No. 909,441, May 25, 1978, abandoned.

[51] Int. Cl.[2] ..... C10L 1/22

[52] U.S. Cl. ..... 44/62; 44/70; 44/71

[58] Field of Search ..... 44/62, 71, 70

[56] References Cited

U.S. PATENT DOCUMENTS

| | | | |
|---|---|---|---|
| 3,166,387 | 1/1965 | Ebner | 44/62 |
| 3,444,082 | 5/1969 | Kautsky | 252/51.5 |
| 3,658,493 | 4/1972 | Hollyday, Jr. | 44/62 |
| 3,765,849 | 10/1973 | Ilnyckyj et al. | 44/62 |
| 3,792,983 | 2/1974 | Tunkel et al. | 44/62 |
| 3,832,150 | 8/1974 | Feldman | 44/62 |
| 3,846,093 | 11/1974 | Feldman | 44/62 |
| 3,846,481 | 11/1974 | Gaydasch | 44/71 |
| 3,910,776 | 10/1975 | Feldman | 44/62 |
| 3,982,909 | 9/1976 | Hollyday, Jr. | 44/71 |
| 4,153,422 | 5/1979 | Wisotsky | 44/62 |
| 4,153,423 | 5/1979 | Wisotsky | 44/62 |
| 4,153,424 | 5/1979 | Wisotsky | 44/62 |

FOREIGN PATENT DOCUMENTS

| | | | |
|---|---|---|---|
| 1469016 | 3/1977 | United Kingdom | 44/62 |

*Primary Examiner*—Winston A. Douglas
*Assistant Examiner*—Y. Harris Smith
*Attorney, Agent, or Firm*—Frank T. Johmann

[57] ABSTRACT

Oil soluble combinations of (A) ethylene polymer or copolymer, (B) a second polymer having alkyl side chains of 6 to 30 carbon atoms, and derived from carboxylic acid esters and/or olefins, and (C) nitrogen compounds, such as amides, amine salts and ammonium salts, of carboxylic acids or anhydrides, are useful in improving the cold flow properties of distillate hydrocarbon fuel oils.

19 Claims, No Drawings

COMBINATION OF ETHYLENE POLYMER, POLYMER HAVING ALKYL SIDE CHAINS, AND NITROGEN CONTAINING COMPOUND TO IMPROVE COLD FLOW PROPERTIES OF DISTILLATE FUEL OILS

RELATED APPLICATIONS

This is a continuation-in-part of my Ser. No. 909,441 filed May 25, 1978, now abandoned.

BACKGROUND OF THE INVENTION

1. Field of the Invention

The invention relates to a three (or more) component additive combination for distillate fuel oils, comprising (A) an ethylene backbone distillate fuel oil pour depressant polymer, (B) a second polymer having alkyl side chains of 6 to 30 carbon atoms defined by carboxylic acid ester or olefin moieties, and (C) a nitrogen compound e.g. amides and salts of a carboxylic acid or anhydride. This combination is particularly useful in distillate fuel oils for controlling the size of wax crystals that form at low temperatures, and for inhibiting agglomeration of the crystals.

2. Description of the Prior Art

Two component additive systems for treating distillate fuel oil to limit the size of wax crystals that form in the fuel oil in cold weather are known, as shown by the following patents.

United Kingdom Pat. No. 1,469,016 teaches ethylene polymer or copolymer, which is a pour depressant for middle distillate fuel, in combination with a second polymer having alkyl groups of 6 to 18 carbon atoms, which is a polymer of an olefin or unsaturated dicarboxylic acid ester, is useful in improving the cold flow properties of middle distillate fuel oils.

U.S. Pat. No. 3,982,909 teaches nitrogen compounds such as amides, diamides, and ammonium salts of: monoamides or monoesters of dicarboxylic acids, alone or in combination with a hydrocarbon microcrystalline wax and/or a pour point depressant, particularly an ethylene backbone polymeric pour point depressant, are wax crystal modifiers and cold flow improvers for middle distillate fuel oils, particularly diesel fuel.

U.S. Pat. Nos. 3,444,082 and 3,846,093 teach various amides and salts of alkenyl succinic anhydride reacted with amines, in combination with ethylene copolymer pour point depressants, for distillate fuels.

THE INVENTION

The present invention is based on finding that 3 (or more) component additive systems, comprising an ethylene containing polymer, a polymer of unsaturated carboxylic acid ester and/or olefins, having straight chain alkyl groups of 6 to 30, preferably 12 to 20 carbon atoms, and certain nitrogen compounds have advantages over combinations consisting of any two of said additives, in improving cold flow performance of distillate hydrocarbon oils, particularly when the oil is held in storage tanks at temperatures below its cloud point for extended periods.

The distillate fuel oil, to which flow improvers may be added, is stored in large tanks at refineries or at marketing depots or at final distribution terminals. Due to the large volume of the oil in such tanks, the bulk oil temperature only slowly drops, even though the ambient temperature may be considerably below the cloud point (the temperature at which the wax begins to crystallize out and becomes visible, i.e., the oil becomes cloudy).

If the winter is particularly cold and prolonged so that such bulk oil is in quiescent storage for a long period of time during very cold weather, the bulk oil may eventually drop below its cloud point. These conditions may then result in the phenomenon of crystallized wax settling to the bottom of the tank under the influence of gravity. As a further result, a bottom layer of oil forms which has an enriched wax content and a cloud point considerably higher than that of the fuel originally pumped into the tank. At the same time, the upper layers of the oil are now partially dewaxed and have a relatively low cloud point. The crystal rich bottom layer of oil will therefore exhibit a greater tendency towards wax agglomeration, as the crystals are more concentrated, than the upper layers. Since the outlets from these tanks are near their bottom, then if oil is drawn off so as to fill a delivery truck, such oil could have an abnormally high amount of wax. In addition, the wax could be in the form of relatively large crystallites due to said crystal agglomeration. Such large crystallites of wax, in turn, can lead to distribution problems as it may subsequently block protective screens or filters on the truck, clog filters on small diameter fuel lines in the customer's storage system, etc.

In general, the three component additive combination of the invention has been found effective in not only keeping the initially formed wax crystals small, but also in slowing settling of such wax crystals by gravity in oil and in inihibiting their agglomeration.

In accordance with the present invention, a fuel composition is provided which comprises distillate fuel oil and from about 0.001 to 0.5 wt. %, e.g. 0.01 to 0.1 wt. %, of a flow and filterability improving, multicomponent additive composition comprising: (A) one part by weight of oil soluble ethylene backbone distillate flow improving polymer; (B) 0.1 to 10, e.g. 0.2 to 5 parts by weight of a second oil soluble polymer of ester and/or olefins; and (C) 0.01 to 10, e.g. 0.2 to 5 parts by weight of a nitrogen compound which may be amides and/or amine salts of carboxylic acids or ammonium salts of said acids or anhydrides thereof. Concentrates of 30 to 80 wt. % mineral oil and 70 to 20 wt. % of the additive mixture of (A), (B) and (C), dissolved therein, will generally be made for ease in handling the additives.

The Ethylene Polymers, their Derivatives and Copolymers

The ethylene polymers are of the type known in the art as wax crystal modifiers, e.g. pour depressants and cold flow improvers for distillate fuel oils. These polymers will have a polymethylene backbone which is divided into segments by hydrocarbon or oxy-hydrocarbon side chains, or by alicyclic or heterocyclic structures or by chlorine atoms. They may be simply homopolymers of ethylene as prepared by free radical polymerization so as to result in some branching. More usually, they will comprise about 3 to 40, preferably 4 to 20, molar proportions of ethylene per molar proportion of a second ethylenically unsaturated monomer, which latter monomer can be a single monomer or a mixture of such monomers in any proportion. These polymers will generally have a number average molecular weight in the range of about 500 to 50,000, preferably about 800 to about 20,000, e.g., 1000 to 6000, as measured for example by Vapor Pressure Osmometry (VPO), such as using a Mechrolab Vapor Pressure Osmometer Model 302B.

The unsaturated monomers, copolymerizable with ethylene, include unsaturated mono and diesters of the general formula:

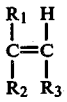

wherein $R_1$ is hydrogen or methyl; $R_2$ is a —$OOCR_4$ or —$COOR_4$ group wherein $R_4$ is hydrogen or a $C_1$ to $C_{28}$, more usually $C_1$ to $C_{16}$, and preferably a $C_1$ to $C_8$, straight or branched chain alkyl group; and $R_3$ is hydrogen or —$COOR_4$. The monomer, when $R_1$ and $R_3$ are hydrogen and $R_2$ is —$OOCR_4$, includes vinyl alcohol esters of $C_1$ to $C_{29}$, more usually $C_1$ to $C_{17}$, monocarboxylic acid, and preferably $C_2$ to $C_5$ monocarboxylic acid. Examples of such esters include vinyl acetate, vinyl isobutyrate, vinyl laurate, vinyl myristate, vinyl palmitate, etc. When $R_2$ is —$COOR_4$ and $R_3$ is hydrogen, such esters include methyl acrylate, isobutyl acrylate, methyl methacrylate, lauryl acrylate, $C_{13}$ Oxo alcohol esters of methacrylic acid, etc. Examples of monomers where $R_1$ is hydrogen and either or both of $R_2$ and $R_3$ are —$COOR_4$ groups, include mono and diesters of unsaturated dicarboxylic acids such as: mono $C_{13}$ Oxo fumarate, di-$C_{13}$ Oxo fumarate, di-isopropyl maleate, di-lauryl fumarate, ethyl methyl fumarate, etc. It is preferred, however, that the acid groups be completely esterified as free acid groups tend to promote haze if moisture is present in the oil.

Another class of monomers that can be copolymerized with ethylene include $C_3$ to $C_{16}$ alpha monoolefins, which can be either branched or unbranched, such as propylene, isobutene, n-octene-1, isooctene-1, n-decene-1, dodecene-1, etc.

Still other monomers include vinyl chloride, although essentially the same result can be obtained preferentially by chlorinating polyethylene, e.g., to a chlorine content of about 10 to 35 wt. %. Or, as previously mentioned, branched polyethylene can be used per se as the pour depressant.

Also included among the ethylene polymers are the hydrogenated polybutadiene flow improvers having mainly 1,4 addition with some 1,2 addition, such as those of U.S. Pat. No. 3,600,311 since they can be considered as being made up of ethylene segments.

The preferred ethylene copolymers can be formed as follows: solvent, and 5–50 wt. % of the total amount of monomer charge other than ethylene are charged to a stainless steel pressure vessel which is equipped with a stirrer and a heat exchanger. The temperature of the pressure vessel is then brought to the desired reaction temperature by passing steam through the heat exchanger, e.g. 70° to 200° C., and pressured to the desired pressure with ethylene, e.g. 700 to 25,000 psig, usually 900 to 7,000 psig. The initiator, usually as a concentrate in solvent (usually the same solvent as used in the reaction) so that it can be pumped, and additional amounts of the monomer charge other than ethylene, e.g. the vinyl ester, can be added to the vessel continuously, or at least periodically, during the reaction time. Also during this reaction time, as ethylene is consumed in the polymerization reaction, additional ethylene is supplied through a pressure controlling regulator so as to maintain the desired reaction pressure fairly constant at all times. The constant temperature in the reactor is maintained with the aid of the heat exchanger. Following the completion of the reaction, usually a total reaction time of ¼ to 10 hours will suffice, the liquid phase is discharged from the reactor and solvent and other volatile constituents of the reaction mixtures are stripped off leaving the copolymer as residue. To facilitate handling and later oil blending, the polymer is generally dissolved in a mineral oil preferably an aromatic solvent, such as heavy aromatic naphtha, to form a concentrate usually containing 10 to 60 wt. % of copolymer.

Usually, based upon 100 parts by weight of copolymer to be produced, about 50 to 1200, preferably 100 to 600 parts by weight of solvent, usually a hydrocarbon solvent such as benzene, hexane, cyclohexane; or other suitable solvents, e.g. t-butyl alcohol, etc., and about 1 to 20 parts by weight of initiator will be used.

The initiator is chosen from a class of compounds which at elevated temperatures undergo a breakdown yielding radicals, such as peroxide or azo-type initiators, including the acyl peroxides of $C_2$ to $C_{18}$ branched or unbranched carboxylic acids, as well as other common initiators. Specific examples of such initiators include dibenzoyl peroxide, ditertiary butyl peroxide, t-butyl perbenzoate, t-butyl peroctanoate, t-butyl hydroperoxide, alpha, alpha', azo-diisobutyronitrile, dilauroyl peroxide, etc. Choice of the initiator, e.g. peroxide, is governed primarily by the desired polymerization conditions, desired structure of the polymer and the efficiency of the initiator. Considering all these factors, tert.-butyl peroctanoate, dilauroyl peroxide and di-t.-butyl peroxide were found to be preferred, but not exclusive initiators.

Mixtures of these ethylene copolymers can also be used. Thus, U.S. Pat. No. 3,916,916 teaches that improved results can be obtained using a mixture of two ethylene copolymers with different solubilities so that one serves primarily as a nucleator to seed the growth of wax crystals, while the more soluble ethylene copolymer serves as a wax crystal growth arrestor to inhibit the growth of the wax crystals as they are formed. A mixture of two ethylene-vinyl acetate copolymers having different solubilities was used in several of the working examples.

The Second Polymer

These oil soluble ester and/or higher olefin polymer will generally have a number average molecular weight in the range of about 1000 to 200,000, e.g. 1,000 to 100,000, preferably 1000 to 50,000, as measured, for example, by Vapor Pressure Osmometry such as by a Mechrolab Vapor Pressure Osmometer, or by Gel Permeation Chromatography. These second polymers include (a) polymers, both homopolymers and copolymers of unsaturated alkyl ester, including copolymers with other unsaturated monomers, e.g. olefins other than ethylene, nitrogen containing monomers, etc. and (b) homopolymers and copolymers of olefins, other than ethylene.

At least about 10 wt. %, preferably at least 25 wt. %, and frequently 50 wt. % or more of the polymer will be in the form of straight chain $C_6$ to $C_{30}$, e.g., $C_8$ to $C_{24}$, e.g. $C_8$ to $C_{16}$ alkyl groups of an alpha olefin or an ester, for example, the alkyl portion of an alcohol used to esterify a mono or dicarboxylic acid, or anhydride. To illustrate, using a $C_{16}$ straight chain alkyl acrylate as the source of the aforesaid straight chain alkyl group. One could have a homopolymer of n-hexadecyl acrylate. Or one could have a copolymer of said n-hexadecyl acrylate with a short chain monomer, e.g. a copolymer of n-hexadecyl acrylate with methyl acrylate. Or one could have n-hexadecyl acrylate copolymerized with docosanyl acrylate. Or, one could have a terpolymer of methyl acrylate, n-hexadecyl acrylate, and $C_{30}$ branched chain alkyl acrylate. Or the n-hexadecyl acrylate could be copolymerized with an unsaturated ester other than that derived from acrylic acid, such other ester having its unsaturation either in the acid part or the alcohol part of the molecule, etc.

Among the esters which can be used to make these polymers, including homopolymers and copolymers of two or more monomers, are ethylenically unsaturated, mono- and diesters represented by the formula:

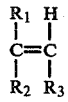

wherein $R_1$ is hydrogen or $C_1$ to $C_6$ hydrocarbyl, preferably alkyl groups, e.g. methyl; $R_2$ is a —$OOCR_4$ or —$COOR_4$ group wherein $R_4$ is hydrogen or a $C_1$ to $C_{30}$, e.g. $C_1$ to $C_{24}$ straight or branched chain hydrocarbyl, e.g. alkyl group; and $R_3$ is hydrogen or —$COOR_4$. The short chain monomers, i.e. those of less than 6 carbons in the alkyl group, will be used as comonomers with the desired long chain monomers, i.e. 6 or more carbons in the alkyl group. The long chain monomers can be used either to make polymers only of long chain monomers, or copolymers with short chain monomers. The monomer, when $R_1$ and $R_3$ are hydrogens and $R_2$ is —$OOCR_4$ includes vinyl alcohol esters of monocarboxylic acids. Examples of such esters include short alkyl chain monomers (used to make copolymers) such as vinyl acetate and vinyl propionate. Long chain monomers include vinyl laurate, vinyl myristate, vinyl palmitate, vinyl behenate, vinyl tricosanate, etc. When $R_2$ is —$COOR_4$, examples of such esters include short chain monomers such as methyl acrylate, methyl methacrylate, and isobutyl acrylate, as well as long chain monomers such as lauryl acrylate, $C_{13}$ Oxo alcohol esters of methacrylic acid, behenyl acrylate, behenyl methacrylate, tricosanyl acrylate, etc. Examples of monomers where $R_1$ is hydrogen and $R_2$ and $R_3$ are both —$COOR_4$ groups, include: mono and diesters of unsaturated dicarboxylic acids such as short alkyl chain monomers, e.g., mono-isopropyl maleate and diisopropyl fumarate, as well as long alkyl chain monomers such as mono $C_{13}$ Oxo fumarate, di-$C_{13}$ Oxo maleate, dieicosyl fumarate, lauryl-hexyl fumarate, didocosyl fumarate, dieicosyl citraconate, di(tricosyl) fumarate, and dipentacosyl citraconate. As earlier indicated, fully esterified esters are preferred in order to reduce haze problems with oils containing moisture.

In addition, minor molar amounts, e.g. 0 to 20 mole %, e.g. 0.1 to 10 mole %, nitrogen-containing monomers can be copolymerized into the polymer, along with the foregoing monomers. These nitrogen-containing monomers include those represented by the formula:

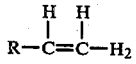

wherein R is a 5- or 6-membered heterocyclic nitrogen-containing ring which can contain one or more substituent hydrocarbon groups. In the above formula, the vinyl radical can be attached to the nitrogen or to a carbon atom in the radical R. Examples of such vinyl derivatives include 2-vinyl pyridine, 4-vinyl pyridine, 2-methyl-2-vinyl pyridine, 2-ethyl-5-vinyl pyridine, 4-methyl-5-vinyl pyridine, N-vinyl pyrrolidone, 4-vinyl pyrrolidone and the like.

Other monomers that can be included are the unsaturated amides such as those of the formula:

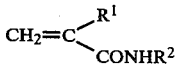

wherein $R^1$ is hydrogen or methyl, and $R^2$ is hydrogen or an alkyl radical or alkenyl radical having up to about 24 carbon atoms. Such amides are obtained by reacting acrylic acid or a low molecular weight acrylic ester with an amine such as butylamine, hexylamine, tetrapropylene amine, cetylamine, ethanolamine and tertiary-alkyl primary amines.

Preferred ester polymers for the present purpose, from the point of view of availability and cost, are copolymers of vinyl acetate and dialkyl fumarate in about equimolar proportions, and also the polymers, including copolymers, of acrylic esters or methacrylic esters. The alcohols used to prepare the fumarate and said acrylic and methacrylic ester are usually monohydric, saturated, straight chain primary aliphatic alcohols containing from 4, e.g. 6 to 30 carbon atoms in the molecule. These esters need not be pure, but may be prepared from technical grade mixtures.

Any mixtures of two or more polymers of the esters set forth herein can also be used. These may be simple mixtures of such polymer, or they may be copolymers which can be prepared by polymerizing a mixture of two or more of the monomeric esters. Mixed esters derived by the reaction of a single or mixed acids with a mixture of alcohols, etc. may be used.

The ester polymers are generally prepared by polymerizing the ester monomers in a solution of a hydrocarbon solvent such as heptane, benzene, cyclohexane, or white oil, at a temperature generally in the range of from 60° C. to 250° C. and usually promoted with a free radical initiator, e.g. a peroxide or azo type initiator, e.g. benzoyl peroxide, under a blanket of refluxing solvent or an inert gas such as nitrogen or carbon dioxide in order to exclude oxygen.

The unsaturated carboxylic acid ester can also be copolymerized with an olefin. If a dicarboxylic acid anhydride is used, e.g. maleic anhydride, it can be polymerized with the olefin, and then esterified with alcohol. To further illustrate, the ethylenically unsaturated carboxylic acid or derivative thereof is reacted with an olefin, such as $C_8$–$C_{32}$, preferably $C_{10}$–$C_{26}$ olefin, usually an alpha olefin, by mixing the olefin and acid, e.g. maleic anhydride, usually in about equimolar amounts, and heating to a temperature of at least 80° C., preferably at least 125° C. A free radical polymerization promoter such as di-lauroyl peroxide, t-butyl hydroperoxide or di-t-butyl peroxide, is normally used. The resulting copolymer thus prepared is then esterified with alcohol. Copolymers of maleic anhydride with styrene, or cracked wax olefins, which copolymers are then completely esterified with alcohol are other examples of the olefin-ester polymer.

Another useful class of said second polymer are olefin polymers, which can be either homopolymers and copolymers of long chain $C_8$ to $C_{32}$, preferably $C_{10}$ to $C_{26}$, aliphatic alpha-monoolefins or copolymers of said long chain alpha-monoolefins with shorter chain $C_3$ to $C_7$ aliphatic alpha-olefins or with styrene or its derivatives, e.g. copolymers comprising 20 to 90 wt. % of said $C_8$ to $C_{32}$ alpha-olefin and 80 to 10 wt. % of said $C_3$ to $C_7$ aliphatic monoolefin, or styrene-type olefin.

Examples of such monomers include short chain monomers such as propylene, butene-1, hexene-1; and long chain monomers such as octene-1, decene-1, 3-methyl decene-1, tetradecene-1, hexadecene-1, octadecene-1, etc. Examples of styrene-type olefins include styrene and styrene derivatives such as p-methyl styrene, p-isopropyl styrene, alpha-methyl styrene, etc.

These olefin polymers may be conveniently prepared by polymerizing the monomers under relatively mild conditions of temperature and pressure in the presence of a Friedel-Crafts type catalyst, e.g. $AlCl_3$, which will give an irregular polymer, or Ziegler-Natta type of an organo-metallic catalyst, i.e. a mixture of a compound derived from a Group IV, V or VI metal of the Periodic Table in combination with an organometallic compound of a Group I, II or III metal of the Periodic Table, wherein the amount of the compound derived from a Group IV–VI metal may range from 0.01 to 2.0 moles per mole of the organo-metallic compound.

Examples of the Ziegler-Natta type catalysts include the following combinations: aluminum triisobutyl and vanadium trichloride; aluminum triisobutyl, aluminum chloride, and vanadium trichloride; vanadium tetrachloride and aluminum trihexyl; vanadium trichloride and aluminum trihexyl; vanadium triacetyl-acetonate and aluminum diethyl chloride; titanium tetrachloride and aluminum trihexyl; vanadium trichloride and aluminum trihexyl; titanium trichloride and aluminum trihexyl; titanium dichloride and aluminum trihexyl, etc.

The polymerization is usually carried out by mixing the catalyst components in an inert diluent such as a hydrocarbon solvent, e.g. hexane, benzene, toluene, xylene, heptane, etc., and then adding the monomers into the catalyst mixture at atmospheric or superatmospheric pressures and temperatures within the range between about 0° to 120° C., preferably 35° to 85° C. Usually atmospheric pressure is employed when polymerizing monomers containing more than 4 carbon atoms in the molecule and elevated pressures are used if the more volatile $C_3$ or $C_4$ alpha-olefins are present. The time of reaction will depend upon, and is interrelated to, the temperature of the reaction, the choice of catalyst, and the pressure employed. In general, however, ½ to 5 hours will complete the reaction.

Various polymers of the above types are available as lubricating oil pour point depressants, and such lubricating oil pour point depressants have been found to be effective in the additive combinations of the invention as the second polymer.

The Nitrogen Containing Compound

Nitrogen compounds effective in keeping the wax crystals separate from each other, i.e. by inhibiting agglomeration of wax crystals, are used as the third component of the additive mixtures. These compounds include oil soluble amine salts and/or amides, which will be generally formed by reaction of at least one molar proportion hydrocarbyl substituted amines with a molar proportion of hydrocarbyl acid having 1 to 4 carboxylic acid groups, or their anhydrides.

In the case of polycarboxylic acids, or anhydrides thereof, all acid groups may be converted to amine salts or amides, or part of the acid groups may be converted to esters by reaction with hydrocarbyl alcohols, or part of the acid groups may be left unreacted.

The hydrocarbyl groups of the preceding amine, carboxylic acid or anhydride, and alcohol compounds include groups which may be straight or branched chain, saturated or unsaturated, aliphatic, cycloaliphatic, aryl, alkaryl, etc. Said hydrocarbyl groups may contain other groups, or atoms, e.g. hydroxy groups, carbonyl groups, ester groups, or oxygen, or sulfur, or chlorine atoms, etc. These hydrocarbyl groups will usually be long chain, e.g. $C_{12}$ to $C_{40}$, e.g. $C_{14}$ to $C_{24}$. However, some short chains, e.g. $C_1$ to $C_{11}$ may be included as long as the total numbers of carbons is sufficient for solubility. Thus, the resulting compound should contain a sufficient hydrocarbon content so as to be oil soluble and it will therefore normally contain in the range of about 30 to 300, e.g. 36 to 160 total carbon atoms. The number of carbon atoms necessary to confer oil solubility will vary with the degree of polarity of the compound. In general, about 36 or more carbons are preferred for each amide linkage that is present in the compound, while for the more polar amine salts about 72 carbons or more are preferred for each amine salt group. The compound will preferably also have at least one straight chain alkyl segment extending from the compound containing 8 to 40, e.g. 12 to 30 carbon atoms. This straight chain alkyl segment may be in one or several of the amine or ammonium ion, or in the acid, or in the alcohol (if an ester group is also present). At least one ammonium salt, or amine salt, or amide linkage is required to be present in the molecule.

The amines may be primary, secondary, tertiary or quaternary, but preferably are secondary. If amides are to be made, then primary or secondary amines will be used.

Examples of primary amines include n-dodecyl amine, n-tridecyl amine, $C_{13}$ Oxo amine, coco amine, tallow amine, behenyl amine, etc. Examples of secondary amines include methyl-lauryl amine, dodecyl-octyl amine, coco-methyl amine, tallow-methylamine, methyl-n-octyl amine, methyl-n-dodecyl amine, methyl-behenyl amine, ditallow amine etc. Examples of tertiary amines include coco-diethyl amine, cyclohexyl-diethyl amine, coco-dimethyl amine, tri-n-octyl amine, di-methyl-dodecyl amine, methyl-ethyl-coco amine, methyl cetyl stearyl amine, etc. Examples of quaternary amino bases or salts include dimethyl dicetyl amino base, dimethyl distearyl amino chloride, etc.

Amine mixtures may also be used and many amines derived from natural materials are mixtures. Thus, coco amines derived from coconut oil is a mixture of primary amines with straight chain alkyl groups ranging from $C_8$ to $C_{18}$. Another example is tallow amine, derived from hydrogenated tallow acids, which amine is a mixture of $C_{14}$ to $C_{18}$ straight chain alkyl groups. Tallow amine is particularly preferred.

Examples of the carboxylic acids or anhydrides, include formic, acetic, hexanoic, lauric, myristic, palmitic, hydroxy stearic, behenic, naphthenic, salicyclic, acrylic, linoleic, dilinoleic, trilinoleic, maleic, maleic anhydride, fumaric, succinic, succinic anhydride, alkenyl succinic anhydride, adipic, glutaric, sebacic, lactic, malic, malonic, citraconic, phthalic acids (o, m, or p), e.g. terephthalic, phthalic anhydride, citric, gluconic, tartaric, 9,10-di-hydroxystearic, etc.

Specific examples of alcohols include 1-tetradecanol, 1-hexadecanol, 1-octadecanol, $C_{12}$ to $C_{18}$ Oxo alcohols made from a mixture of cracked wax olefins, 1-hexadecanol, 1-octadecanol, behenyl alcohol, 1,2-dihydroxy octadecane, 1,10-dihydroxydecane, etc.

The amides can be formed in a conventional manner by heating a primary or secondary amine with acid, or acid anhydride. Similarly, the ester is prepared in a conventional manner by heating the alcohol and the polycarboxylic acid to partially esterify the acid or anhydride (so that one or more carboxylic groups remain for the reaction with the amine to form the amide or amine salt). The ammonium salts are also conventionally prepared by simply mixing the amine (or ammonium hydroxide) with the acid or acid anhydride, or the partial ester of a polycarboxylic acid, or partial amide of a polycarboxylic acid, with stirring, generally with mild heating (e.g. 70°–80° C.).

Particularly preferred are nitrogen compounds of the above type that are prepared from dicarboxylic acids, optimally the aliphatic dicarboxylic acids. Mixed amine salts/amides are most preferred, and these can be prepared by heating maleic anhydride, or alkenyl succinic anhydride with a secondary amine, preferably tallow amine, at a mild temperature, e.g. 80° C. without the removal of water.

The Distillate Fuels

The distillate fuel oils will generally boil within the range of about 120° C. to about 500° C., e.g. 150° to about 400° C. The fuel oil can comprise atmospheric distillate or vacuum distillate, or cracked gas oil or a blend in any proportion of straight run and thermally and/or catalytically cracked distillates, etc. The most common petroleum distillate fuels are kerosene, jet fuels, diesel fuels and heating oils. The heating oil may be a straight atmospheric distillate, or it may frequently contain minor amounts, e.g. 0 to 35 wt. %, of vacuum gas oil and/or of cracked gas oils. The low temperature flow problem is most usually encountered with diesel fuels and with heating oils.

Of recent years, there has also been a tendency to increase the final boiling point (FBP) of distillates so as to maximize the yield of fuels. These fuels, however, include longer chain n-paraffins and generally will have higher cloud points. This, in turn, will usually mean that wax crystals become even more of a problem in cold weather by aggravating the difficulties encountered with oil movement due to the plugging by wax of pipelines, screens, filters, meters, etc.

The final composition of the invention will generally comprise a major amount of the distillate fuel and about 0.001 to 0.2 wt. %, preferably 0.005 to 0.10 wt. % of the aforedescribed oil soluble ethylene containing flow improvers; about 0.005 to 0.30, preferably 0.01 to 0.10 wt. % of the aforesaid oil soluble second polymer and from about 0.001 to 0.2 wt. %, preferably 0.005 to 0.10 wt. % of the aforementioned oil soluble nitrogen compound; wherein said weight percents are based on the weight of the total composition.

Oil soluble, as used herein, means that the additives are soluble in the fuel at ambient temperatures, e.g., at least to the extent of about 0.1 wt. % additive in the fuel oil at 25° C., although at least some of the additive comes out of solution near the cloud point in order to modify the wax crystals that form.

The invention will be further understood by reference to the following Examples which include preferred embodiments of the invention.

EXAMPLE I

In carrying out this Example, the following additive materials were used:

Polymer 1

Polymer 1 used in this Example, was a concentrate in about 55 wt. % of heavy aromatic naphtha oil and about 45 wt. % of a mixture of two ethylene-vinyl acetate copolymers, having different oil solubilities, so that one functions primarily as a wax growth arrestor and the other as a nucleator, in accord with the teachings of U.S. Pat. No. 3,916,916 which patent is hereby incorporated herein in its entirety. More specifically, said Polymer 1 is a polymer mixture of about 75 wt. % of wax growth arrestor and about 25 wt. % of nucleator.

The wax growth arrestor was a copolymer of ethylene and about 38 wt. % vinyl acetate, and had a number average molecular weight of about 1800 (VPO). It is identified in said U.S. Pat. No. 3,916,916 as Copolymer B of Example 1 (column 8, lines 25–35).

The nucleator was a copolymer of ethylene and about 16 wt. % vinyl acetate and had a molecular weight of about 3000 (VPO). It is identified in said U.S. Pat. No. 3,916,916 as Copolymer H (see Table I, columns 7–8).

Polymer A

This was an oil concentrate of about 50 wt. % of mineral lubricating oil and about 50 wt. % of a copolymer of dialkyl fumarate and vinyl acetate in about equimolar proportions, having a number average molecular weight (VPO) of about 15,000 prepared in a conventional manner using a peroxide initiator. The fumarate was prepared by esterifying fumaric acid with a mixture of straight chain alcohols averaging about $C_{12}$. A typical analysis of the alcohol mixture is as follows: 0.7 wt. % $C_6$, 10 wt. % $C_8$, 7 wt. % $C_{10}$, 47 wt. % $C_{12}$, 17 wt. % $C_{14}$, 8 wt. % $C_{16}$, 10 wt. % $C_{18}$.

Polymer B

Polymer B was Acryloid 157 which is a lubricating oil pour depressant for highly paraffinic oils sold by the Rohm and Haas Co. Dialysis indicated that Acryloid 157 consists of about 37 wt. % light hydrocarbon oil and about 63 wt. % of active ingredient. The active ingredient has a specific viscosity of about 0.44 at a 2% concentration in xylene at 100° C., and is a polymer comprising mainly alkyl methacrylate groups.

Nitrogen Compound A

This compound was prepared in accordance with U.S. Pat. No. 3,982,908 and is an amine salt of the monoamide of maleic anhydride. It was prepared by reacting maleic anhydride with secondary hydrogenated tallow amine (about 505 mol. wt.). The structure and composition of its principal component is:

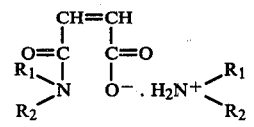

The secondary hydrogenated tallow amine is a commercially available product sold by Armak Co., Chemicals Division, Chicago, Illinois and designated Armeen 2HT. For this reason, the $R_1$ and $R_2$ n-alkyl groups of the

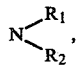

since they are derived from tallow fat which is approximately 3% $C_{14}H_{29}$, 34% $C_{16}H_{33}$ and 63% $C_{18}H_{37}$, are mixed.

A laboratory preparation of nitrogen compound A is as follows:

Ten grams (0.102 mole) of maleic anhydride, 100 gm. (0.198 mole) of secondary hydrogenated tallow amine of a molecular weight of about 505, and 200 ml. of benzene as a solvent are refluxed for 3 hours at 85° C. in a 4-neck flask equipped with stirrer, thermometer, condenser and water trap. No water formed under these conditions. The reaction mixture was removed and the solvent distilled off to give 109.3 gms. of a maleamic acid amine salt, melting point 64° C.

Nitrogen Compound B

This was a diamide formed by reacting 2 moles of the aforesaid hydrogenated tallow amine with one mole of maleic anhydride and dehydrating the reaction product by heating to about 150° C.

The Oil

The oil was a distillate fuel oil having a WAP (Wax Appearance Point as discussed in ASTM D-3117) of −1.5° C. and a distillation range as follows: I.B.P. (initial boiling point) of 162° C.; 20% distillation point of 203° C.; 90% distillation point of 337° C. and FBP (final boiling point) of 375° C.

Blends 1 to 4

Oil Blends 1 to 4 were made up by dissolving the additives into the fuel oil by stirring, generally while warming the oil on a hot plate to about 90° C. The polymer additives were added in the form of the aforesaid oil concentrates while the amine salt was added to the oil directly.

The blends, in a conventional laboratory 1000 ml. graduate, were cold soaked by being quietly cooled from room temperature of about 20° C. to −6.5° C. in a cold box and then held at −6.5° C. for 24 hours and 48 hours. Then the cold oil blends were visually examined. Next, the bottom 10% of the cold oil blend was drawn off and subjected to a screen test which involved using a test device, comprising a 20 ml. pipette to which vacuum is applied at the upper end, while its lower end terminates in an inverted funnel across which is stretched on fine mesh screen having a diameter of about 12 mm. The test device is inserted into a 50 ml. sample of the cold oil in a CFPP testing tube and vacuum of about 8 inches of water is applied. A "pass" result was obtained where the cloudy oil filled the pipette to the 20 ml. mark without plugging the screen. Pipettes with different mesh screens were used. The smaller the size of the wax crystals that form, the finer the mesh screen which will be passed by the wax-cloudy oil.

The blends prepared and their properties are summarized in the following Table I.

TABLE I

| | | After 24 Hr. Cold Soak at −6.5° C. | | | | After 48 Hr. Cold Soak at −6.5° C. | | | |
|---|---|---|---|---|---|---|---|---|---|
| | | Waxy Layer | Bottom 10% | | | Waxy Layer | Bottom 10% | | |
| | | Vol. % | | Screen Mesh | | Vol. % | | Screen Mesh | |
| Blend* | Additive Conc., ppm | (visual) | WAP, °C. | Pass | Fail | (visual) | WAP, °C. | Pass | Fail |
| 1 | 500 Polymer 1 | 15% | + 10.5 | 150 | 250 | 15% | + 10.5 | 100 | 150 |
| 2 | 150 ppm Polymer 1<br>150 ppm Nitrogen Cmpd. A<br>250 ppm Polymer A | 100% | + 1.0 | 250 | — | 90% | + 5.5 | 250 | — |
| 3 | 150 ppm Polymer 1<br>75 ppm Nitrogen Cmpd. A<br>125 ppm Polymer B | 100% | ±0 | 250 | — | 100% | + 2.0 | 250 | — |
| 4 | 175 ppm Polymer 1<br>100 ppm Nitrogen Cmpd. B<br>150 ppm Polymer B | 30% | + 9.5 | 250 | — | 30% | + 9.0 | 250 | — |

*Wax Appearance Point (WAP) of the base oil was −1.5° C.

Table I shows that the 3-component additive systems of Blends 2, 3 and 4 all gave a higher degree of wax dispersion, and for the bottom fraction lower wax appearance points (WAP), and smaller wax crystals as indicated by the passage of the cold oil through the 250 mesh screen, than Blend 1 containing only the ethylene polymer component. Blend 4 performed in the filterability test as well as Blends 2 and 3, despite the fact that in contrast to the latter blends, it showed a considerable wax settling. This indicates that it is not wax settling by itself, but the agglomeration of the wax crystals in the presence of less effective flow improver, which is harmful to the performance of an oil.

EXAMPLE II

Polymer 2

In several of the Blends, Polymer 2 was used which was a concentrate of 45 wt. % of the wax growth arrestor of Polymer 1 (i.e. the ethylene-vinyl acetate copolymer of 38 wt. % vinyl acetate and 1800 molecular weight, as described above) in 55 wt. % of light hydrocarbon oil.

Polymer C

This consisted of a concentrate of about 45 wt. % of copolymer of about equimolar proportion of vinyl acetate and alkyl fumarate, having a specific viscosity of about 0.61 at a 2 wt. % concentration in xylene at 38° C. and a number average molecular weight of about 15,000 in about 55 wt. % light hydrocarbon oil. The alkyl groups of the fumarate were derived from a mixture of $C_8$ to $C_{18}$ linear primary alcohols, said mixture having an average molecular weight of about 188.

The Fuel Oil

Here, the middle distillate fuel oil had a cloud point of −6° C.; and a WAP of −6° C.; and IBP (Initial Boiling Point) of 160° C.; a 20% distillation point of 217° C.; a 90% distillation point of 327° C., and a FBP of 361° C.

Blends 5 to 10 were made in the oil and cooled to −13° C. in a cold box in a 500 ml. graduate at 1° C./hr., then held at −13° C. for 48 hours. The appearance of the oil was then noted, and the bottom 10% of the oil was removed, and examined for WAP and for its filterability as determined by different mesh screens using the aforesaid pipette device.

The blends and the results are summarized in Table II.

TABLE II

| Blend* | ppm Additive | After 48 Hrs. Cold Soak at −13° C. Waxy Layer Vol. % (Visual) | Bottom 10% WAP, °C. | Screen Mesh Pass | Screen Mesh Fail |
|---|---|---|---|---|---|
| 5 | 800 ppm Polymer 1 | 40 | + 2 | 85 | 100 |
| 6 | 800 ppm Polymer 2 | 40 | + 3 | 60 | 85 |
| 7 | 400 ppm Polymer 1<br>200 ppm Nitrogen Compound A<br>200 ppm Polymer A | 100 | − 2 | 250 | — |
| 8 | 400 ppm Polymer 2<br>200 ppm Nitrogen Compound A<br>240 ppm Polymer A | 100 | − 6 | 250 | — |
| 9 | 400 ppm Polymer 2<br>200 ppm Nitrogen Compound A<br>240 ppm Polymer C | 100 | − 4 | 250 | — |
| 10 | 400 ppm Polymer 2<br>120 ppm Nitrogen Compound A<br>160 ppm Polymer B | 100 | − 5 | 250 | — |

*WAP of base oil is −6° C.

Table II shows that the three-component systems of Blends 7 to 10 were superior in keeping the wax dispersed, maintaining a low WAP of the bottom portion of the oil, and keeping the wax crystals small as measured by their ability to pass through the 250 mesh screen. This is in contrast to Blends 5 and 6 containing the 800 parts per million of the oil concentrates of the ethylene copolymers.

EXAMPLE III

The middle distillate fuel oil used in this Example had a WAP of +1° C., a cloud point of +2° C., an IBP of 177° C., a 20% distillation point of 222° C., a 90% distillation point of 339° C. and a FBP of 367° C.

The additives and test procedures were the same as in Example II. The blends and their test results are summarized in Table III.

TABLE III

| Blend* | ppm Additive | After 48 Hrs. Cold Soak at −6.5° C. Waxy Layer Vol. % (Visual) | Bottom 10% WAP, °C. | Screen Mesh Pass | Screen Mesh Fail |
|---|---|---|---|---|---|
| 11 | 1000 ppm Polymer 1 | 30 | + 9 | 120 | 150 |
| 12 | 500 ppm Polymer 1<br>250 ppm Nitrogen Compound A | 60 | +15 | 40 | 60 |
| 13 | 400 ppm Polymer 1<br>200 ppm Nitrogen Compound A<br>400 ppm Polymer A | 30 | +11 | 60 | 85 |
| 14 | 500 ppm Polymer 2<br>250 ppm Nitrogen Compund A | 80 | + 7 | 120 | 150 |
| 15 | 450 ppm Polymer 2<br>200 ppm Nitrogen Compound A<br>400 ppm Polymer A | 90 | + 2.5 | 120 | 150 |
| 16 | 400 ppm Polymer 2<br>200 ppm Nitrogen Compound A<br>160 ppm Polymer B | 100 | + 3 | 250 | — |

*WAP of the base oil was + 1° C.

Comparing Blend 12 to 11, it is seen that the Nitrogen Compound A of Blend 12 improved the visually determined dispersion of the wax in the oil. Blend 13 improved the WAP and filterability, as measured by mesh screen passed, as compared to Blend 12. Blend 13 is not directly comparable to Blend 11 in this regard due to the considerably lower concentration of Polymer 1, namely 400 parts per million in Blend 13 versus 1000 ppm in Blend 11. However, looking at the three component systems of Blends 15 and 16 compared to the two component system of Blend 14, it is seen that where comparisons are made on the basis of same content of the ethylene copolymer concentrate (Polymer 2), that Blends 15 and 16 were superior to Blend 14.

EXAMPLE IV

The oil of this example was a middle distillate fuel oil of −3.5° C. WAP, an IBP of 170° C., a 20% distillation point of 225° C., a 90% distillation point of 340° C. and a FBP of 377.

It was tested in the manner of Example III using previously described additives. Results are in Table IV.

TABLE IV

| Blend* | ppm Additive | After 48 Hrs. Cold Soak at −6.5° C. Waxy Layer Vol. % (Visual) | Bottom 10% WAP, °C. | Screen Mesh Pass | Fail |
|---|---|---|---|---|---|
| 17 | 800 ppm Polymer 1 | 20% | + 6 | 120 | 250 |
| 18 | 170 ppm Polymer 1<br>100 ppm Nitrogen Compound A<br>220 ppm Polymer A | 100% | −3.5 | 250 | — |
| 19 | 170 ppm Polymer 1<br>100 ppm Nitrogen Compound A<br>220 ppm Polymer C | 100% | − 3 | 250 | — |
| 20 | 210 ppm Polymer 1<br>60 ppm Nitrogen Compound A<br>150 ppm Polymer B | 100% | −3.5 | 250 | — |
| 21 | 240 ppm Polymer 1<br>60 ppm Nitrogen Compound B<br>180 ppm Polymer B | 100% | − 2 | 250 | — |

*WAP of the base oil was −3.5° C.

Table IV shows that the 3-component systems of Blends 18, 19, 20 and 21 were much more effective than the one-component system of Blend 17 in preventing wax settling.

EXAMPLE V

The oil of this Example was an atmospheric middle distillate fuel oil having a 0° C., cloud point, an IBP of 173° C., a 20% distillation point of 225° C., a 90% distillation point of 343° C., and a FBP of 371° C.

Several of the previously described additives were used to prepare the fuel oil blends. In addition, two additional lubricating oil pour depressants sold by the Rohm and Haas Company known as Acryloid 154 and Acryloid 156 were tested. Acryloid 154 was a mineral oil concentrate which contained about 65 wt. % of active ingredient as determine by dialysis. The specific viscosity of this active ingredient was about 0.21 as determined at a 2 wt. % concentration in xylene @ 38° C. The active ingredient comprises principally a methacrylate polymer. Acryloid 156 was also a mineral oil concentrate which contained about 64 wt. % active ingredient by dialysis. The active ingredient had a specific viscosity of about 0.43 at a 2% concentration in xylene at 38° C., and comprises principally a methacrylate polymer. Acryloid 154 is hereinafter referred to as Polymer D, while Acryloid 156 is hereinafter referred to as Polymer E.

Polymer F was another lubricating oil pour depressant additive which was tested. This material consisted of about 50 wt. % light mineral lubricating oil containing about 50 wt. % of a copolymer of octadecene-1 and maleic anhydride in about equimolar proportions, prepared by free radical polymerization. The copolymer was esterified with about 1.6 molar proportion of a mixture of $C_8$–$C_{16}$ linear primary alcohols having an average molecular weight of about 192, per molar proportion of maleic anhydride in the copolymer. The number average molecular weight of the partially esterified copolymer was on the order of about 6000.

The oil blends in 500 ml. containers were cooled in the cold box from room temperature down to −7° C. at the rate of about 1° C./hr., and cold soaked at −7° C. for 24 hours except for Blend 23 which was cold soaked for 6 hours. Then, the lower 10% bottom portion was drawn off and after being warmed to room temperature so that the wax redissolved in the oil, was tested for ASTM Cloud Point and in the CFPP test.

The Cold Filter Plugging Point (CFPP) Test

This test is carried out by the general procedure described in "Journal of the Institute of Petroleum," Volumn 52, Number 510, June 1966 pp. 173–185. In brief, a 40 ml. sample of the oil to be tested is cooled in a specially designed tester, by a bath maintained at about −34° C. Periodically (at each one degree Centigrade drop in temperature starting at least from 2° C. above the cloud point of the oil) the cooled oil is tested for its ability to flow through a fine screen in a time period using a test device which is a pipette to whose lower end is attached an inverted funnel which is positioned below the surface of the oil to be tested. Stretched across the mouth of the funnel is a 350 mesh screen having a diameter of 12 mm. The periodic tests are each initiated by applying a vacuum of about 8" of water to the upper end of the pipette whereby oil is drawn through the screen up into the pipette to a mark indicating 20 ml. of oil. The test is repeated with each one degree drop in oil temperature until the oil fails to fill the pipette within 60 seconds. The results of the test are reported as the temperature (the plugging point) in °C. at which the oils fail to fill the pipette in the prescribed time of 1 minute.

The blends prepared and their test results are summarized in Table V which follows.

TABLE V

| Blend* | Wt. % Additive | CFPP, °C. Before Cold Soak | 10% Bottom After 24 Hrs. Cold Soak at −7° C. ASTM Cloud, °C. | CFPP, °C. |
|---|---|---|---|---|
| 22 | No additive | − 1 | 0 | 0 |
| 23 | .03% Polymer 1 | − 11 | + 11** | + 3** |
| 24 | .05% Polymer 1<br>.025% Polymer B | − 5 | + 9 | − 3 |
| 25 | .02% Nitrogen Cmpd. A<br>.02% Polymer A | −10 | + 2 | − 8 |
| 26 | .03% Polymer 1<br>.01% Nitrogen Cmpd. A<br>.025% Polymer A | − 9 | + 9 | + 4 |

TABLE V-continued

| Blend* | Wt. % Additive | CFPP, °C. Before Cold Soak | 10% Bottom After 24 Hrs. Cold Soak at −7° C. ASTM Cloud, °C. | CFPP, °C. |
|---|---|---|---|---|
| 27 | .03% Polymer 1<br>.01% Nitrogen Cmpd. A<br>.025% Polymer D | − 11 | + 11 | + 6 |
| 28 | .03% Polymer 1<br>.01% Nitrogen Cmpd. A<br>.025% Polymer E | − 9 | + 9 | + 1 |
| 29 | .03% Polymer 1<br>.01% Nitrogen Cmpd. A<br>.025% Polymer B | − 7 | + 2 | − 7 |
| 30 | .03% Polymer 1<br>.01% Nitrogen Cmpd. A<br>.025% Polymer F | − 6 | + 5 | − 2 |
| 31 | .035% Polymer 1<br>.01% Nitrogen Cmpd. A<br>.02% Polymer B | − 8 | (+ 9)? | − 9 |

*ASTM Cloud Point of the base oil is 0° C.
**After 6 hours soak at −7° C.

As shown in Table V, Blend 22 without any additive passed the CFPP test at −1° C. and 0° C., before and after soaking, respectively. The filterability characteristics of Blend 23, which contained Polymer 1, deteriorated severely during the cold soak of 6 hours only. If Blend 23 had been cold soaked for 24 hours, as the other samples were, then the CFPP could have been even significantly higher. The three component systems of Blends 26 to 31 showed CFPP results ranging from no difference between before and after cold soaking in the case of Blend 29, to a difference of 17° C. in the case of Blend 27. Low CFPP results both before and after soaking are of course most desirable. Blend 24 was a two-component system, omitting the nitrogen compound, which gave a desirable low difference in CFPP before and after soaking. However, it contained a significantly higher amount of Polymer 1 than did the other comparison blends, and also showed the least CFPP depression before soaking. The cloud point of +9° C. for Blend 31 may be an anomaly or error as it seems high when considering the low CFPP after the cold soak.

EXAMPLE VI

Polymer 3

This was a concentrate of about 60 wt. % of copolymer of about 50 wt. % of ethylene and about 50 wt. % 2-ethylhexyl acrylate, having a number average molecular weight of about 2000 as measured by Vapor Phase Osmometry (VPO) in about 40 wt. % of light mineral oil.

The oil of this example was a distillate fuel oil of 0° C. ASTM cloud point, and a distillation range (ASTM-D-1160) as follows: IBP of 170° C.; 5% distillation point of 188° C.; 20% distillation point of 225° C.; 90% distillation point of 343° C.; and a final distillation point of 371° C.

Oil blends were prepared in a manner as previously described and 500 ml. of each blend in a laboratory addition glass funnel was subject to quiescent cooling at the rate of 1° C. per hour from room temperature of about 20° C. until the test fuel blend reached a temperature of −7° C. The test blend was thereafter held at −7° C. for a period of 24 hours. Then a 50 ml. sample of this cooled test fuel blend was drawn off from the bottom of the funnel and transferred to another container. This bottom fraction was warmed, e.g. allowed to return to room temperature (about 20° C.) so that the wax was redissolved in the oil, after which it was subjected to the ASTM cloud point determination and to the Cold Filter Plugging Point (CFPP) test.

The results are summarized in the following Table VI.

TABLE VI

| Blend | Wt. % Additive | Total Fuel CFPP, °C. Before Soak | After 24 Hrs. Cold Soak at −7° C. Waxy Layer Vol.% (Visual) | 10% Bottom CFPP, °C. | 10% Bottom ASTM Cloud, °C. |
|---|---|---|---|---|---|
| 32 | none | − 2 | 95 | − 2 | 0 |
| 33 | .08% Polymer 3 | − 13 | 22 | + 7 | + 12 |
| 34 | .05% Polymer 3<br>.015% Nitrogen Cmpd. A | − 11 | 55 | + 2 | + 9 |
| 35 | .05% Polymer 3<br>.02% Polymer A | − 10 | 25 | − 10 | + 11 |
| 36 | .03% Polymer 3<br>.015% Nitrogen Cmpd. A | − 12 | 100 | − 12 | 0 |

As seen by Table VI, Blend 36 containing the three component system was superior to Polymer 3 by itself (Blend 33) or to the two component system of Blends 34 and 35. Specifically, Blend 36 kept the wax completely dispersed in the oil and prevented settling of the wax crystals as indicated by the 100% volume of the wax layer, i.e. the wax was completely dispersed in the oil. Also, the CFPP test of the 10% bottom portion was −12° C. as was the CFPP of the total fuel, that is the CFPP was very low in both instances. Also, the Cloud Point of Blend 36 was the same as the fuel oil without any additive (Blend 32).

EXAMPLE VII

The following materials were used in this example.

Nitrogen Compound C was an amide-amine salt formed by reacting one molar proportion of phthalic anhydride and two molar proportions of said secondary hydrogenated tallow amine (Armeen 2HT).

Nitrogen Compound D was a diamide of phthalic anhydride and said secondary hydrogenated amine formed by reacting one mole of phthalic anhydride with two moles of said amine with heating in solvent to dehydrate, to thereby form the diamide.

In addition, the aforedescribed Polymers 1, B and C were used in this example.

Two middle distillate fuels were used, having the following characteristics:

Fuel A was a middle distillate fuel oil with a WAP of −6° C., an ASTM cloud point of −3° C., an IBP of 180° C., a 10% distillation point of 211° C., a 50% distillation point of 268° C., a 90% distillation point of 336° C., and a FBP of 365° C. The Cold Filter Plugging Point of the fuel per se (CFPP test) was −7° C.

Fuel B was a middle distillate fuel oil with a WAP of −2.5° C., an IBP of 184° C., a 20% distillation point of 249° C., a 90% distillation point of 351° C. and a final boiling point of 383° C.

Blends 37 to 42 were made up and about 500 ml. of each blend in a glass addition funnel was subjected to a temperature cycling test. Here, the oil was cooled at 1° C./hr. over 10 hours to the test temperature starting at a temperature of 10° C. above the test temperature. For example, the 1° C./hr. cooling was started at −1° C. for a test temperature of −11° C., at +2° C. for a test temperature of −8° C. and at 0° C. for a test temperature of −10° C. The blends were soaked for 30 hours at the test temperature, then warmed up over a period of 2 hours back to the starting temperature, 10° C. above the test temperature, and then held at the starting temperature for 5 hours, then cooled again over 10 hours to the test temperature at the rate of about 1° C./hour, and then cold soaked at the test temperature for about 10 hours. The bottom 10% of the oil blend was then removed and subjected to a modified CFPP test. In this modified test, the 50 ml. bottom sample at the test temperature, is drawn by 200 mm. water vacuum through a filter screen into the 20 ml. pipette of the CFPP test device and the minimum mesh screen through which the oil blend will pass before plugging the screen was determined. The composition of the blends tested and their results are summarized in the following Table VII.

Table VII

| | | Minimum Mesh Screen Passed | | |
|---|---|---|---|---|
| | | Fuel A | Fuel B | |
| Blend | ppm Additive | −11° C. Test Temp. | −8° C. Test | −10° C. Test |
| 37 | 200 ppm Polymer 1 | 120 | Blocked 20 | 20 |
| 38 | 500 ppm Polymer 1 | 200 | 60 | 60 |
| 39 | 600 ppm Polymer 1 | 200 | — | 60 |
| 40 | 200 ppm Polymer 1<br>200 ppm Polymer C<br>100 ppm Nitrogen Cmpd. C | 350 | 150 | 120 |
| 41 | 200 ppm Polymer 1<br>200 ppm Polymer B<br>100 ppm Nitrogen Cmpd. C | — | — | 120 |
| 42 | 200 ppm Polymer 1<br>200 ppm Polymer C<br>100 ppm Nitrogen Cmpd. D | 350 | 120 | 120 |

As seen by Table VII, Blends 40 to 42 containing the three components were considerably more effective in keeping the wax crystals small as indicated by the ability of these blends to pass through finer mesh screens, than the comparison Blends 37 to 39 which only contained Polymer 1.

The preceding Examples I to VII used the polymers in the form of concentrates and for this reason, Tables I to VII report the amount of polymer concentrate used. The actual amount of polymer per se, i.e. the active ingredient, is less. To illustrate, Blend 1 used 500 parts per million by weight, based on the weight of oil, of Polymer 1, which was a concentrate of 45% actual polymer. Thus, 225 ppm of actual polymer was used in Blend 1. The weight % ranges and relative amounts of the three additive components of the invention, given in the specification and in the claims are based upon active ingredients, i.e. the polymers per se and the nitrogen compound per se.

What is claimed is:

1. A wax-containing petroleum fuel oil comprising a major proportion of a distillate oil boiling in the range of 120° to 500° C., which fuel oil has been improved in its low temperature flow properties, containing in the range of about 0.001 to 0.5 wt. %, based on the weight of the total composition, of a flow improving combination of:

(A) one part by weight of an oil-soluble ethylene backbone distillate flow improving polymer having a number average molecular weight in the range of about 500 to 50,000;

(B) 0.1 to 10 parts by weight of a second oil-soluble polymer of monomers other than ethylene, having a molecular weight in the range of about 1000 to 200,000 wherein at least 10% by weight of said polymer is in the form of straight chain alkyl groups having 6 to 30 carbon atoms, said polymer comprising unsaturated ester, or unsaturated ester and olefin, monomer moieties, said moieties comprising a major weight proportion of said polymer; and (C) 0.01 to 10 parts by weight of an oil soluble nitrogen compound containing a total of about 30 to 300 carbon atoms and having at least one straight chain alkyl segment of 8 to 40 carbons, and selected from the class consisting of amine salts and/or amides of hydrocarbyl carboxylic acids or anhydrides having 1 to 4 carbonyl groups.

2. A fuel oil according to claim 1, which has been improved in its ability to maintain crystallized wax in a dispersed form during storage, and wherein said ethylene backbone polymer (A) is selected from the group consisting of branched polyethylene, hydrogenated polybutadiene, chlorinated polyethylene of 10 to 35 wt.

% chlorine, and copolymers comprising essentially 3 to 40 molar proportions of ethylene with a molar proportion of a comonomer selected from the group consisting of: $C_3$ to $C_{16}$ alpha monoolefin, vinyl chloride, and ethylenically unsaturated alkyl ester of the formula:

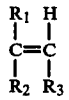

wherein $R_1$ is hydrogen or methyl; $R_2$ is a —$OOCR_4$ or —$COOR_4$ group; $R_4$ is hydrogen or a $C_1$ to $C_{28}$ alkyl group; and $R_3$ is hydrogen or —$COOR_4$, and mixtures of said comonomers.

3. A fuel oil according to claim 2, wherein said second polymer (B) is a polymer of at least one monomer moiety selected from the group consisting of $C_6$ to $C_{30}$ straight chain alkyl ester of monoethylenically unsaturated carboxylic acid, said second polymer being further characterized in that at least 10 wt. % of the polymer is in the form of $C_6$ to $C_{30}$ alkyl groups defined by said monomer moieties.

4. A fuel oil according to claim 3, wherein said nitrogen compound (C) is an aliphatic $C_4$ dicarboxylic acid or anhydride wherein one of said carboxylic acid groups is reacted with either $C_{12}$ to $C_{30}$ straight chain alcohol or a secondary alkyl monoamine having $C_{12}$ to $C_{30}$ straight chain alkyl groups, to thereby form a monoester or a monoamide, and the other of said carboxylic acid groups is reacted to form an amide or amine salt with a secondary alkyl monoamine having $C_{12}$ to $C_{30}$ straight chain alkyl groups.

5. A fuel oil according to claim 3, wherein said nitrogen compound (C) is an aromatic dicarboxylic acid or anhydride reacted with a secondary alkyl monoamine having $C_{12}$ to $C_{30}$ straight chain alkyl groups.

6. A fuel oil composition according to claim 3, wherein said parts by weight of (B) ranges from 0.2 to 5, and said parts by weight of (C) ranges from 0.2 to 5, per parts by weight of (A).

7. A fuel oil composition according to claim 1, wherein said ethylene backbone distillate flow improving polymer (A) is a copolymer of 4 to 20 molar proportions of ethylene per molar proportion of unsaturated ester of the general formula:

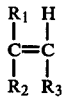

wherein $R_1$ is hydrogen or methyl; $R_2$ is a —$OOCR_4$ or —$COOR_4$ group; wherein $R_3$ is hydrogen or —$COOR_4$; and $R_4$ is hydrogen or a $C_1$ to $C_8$ alkyl group, said copolymer having a number average molecular weight in the range of about 800 to 20,000.

8. A fuel oil composition according to claim 7, wherein said second polymer (B) is selected from the group consisting of copolymers of vinyl acetate and dialkyl fumarate, polymers consisting essentially of alkyl methacrylate moieties, and esters of polymers of $C_8$ to $C_{32}$ alpha monoolefin with maleic anhydride.

9. A fuel oil composition according to claim 8, wherein said nitrogen compound (C) is a $C_4$ dicarboxylic acid having both of its carboxylic acid groups reacted with secondary alkyl monoamine having alkyl groups essentially of 14 to 18 carbon atoms.

10. A fuel oil composition according to claim 8, wherein said nitrogen compound (C) is a phthalic acid or phthalic anhydride having both of its carboxylic acid groups reacted with secondary alkyl monoamine having alkyl groups essentially of 14 to 18 carbon atoms.

11. A fuel oil composition according to claim 9, wherein said fuel oil is a distillate produced by atmospheric distillation, wherein said ethylene backbone distillate flow improving polymer (A) is a copolymer of ethylene and vinyl acetate and said nitrogen compound (C) is an amine salt of maleic monoamide having a structure

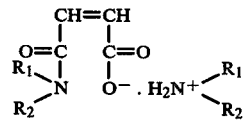

wherein $R_1$ and $R_2$ are the same or different and represent hydrogen or an alkyl group ranging from 14 to 18 carbons.

12. A fuel oil composition according to claim 9, wherein said fuel oil is a distillate produced by atmospheric distillation, wherein said ethylene backbone distillate flow improver polymer (A) is a copolymer of ethylene and vinyl acetate, and said nitrogen compound (C) is the reaction product of phthalic anhydride and hydrogenated secondary tallow amine.

13. An additive concentrate useful for treating distillate fuel oils comprising about 30 to 80 wt. % of a diluent oil and about 70 to 20 wt. % of an additive combination of:

(A) one part by weight of an oil-soluble ethylene backbone distillate flow improving polymer having a number average molecular weight in the range of about 500 to 50,000;

(B) 0.1 to 10 parts by weight of a second oil-soluble polymer of monomers other than ethylene having a molecular weight in the range of about 1000 to 200,000 wherein at least 10% by weight of said polymer is in the form of straight chain alkyl groups having 6 to 30 carbon atoms, said polymer comprising unsaturated ester, or unsaturated ester and olefin, monomer moieties, said moieties comprising a major weight proportion of said polymer; and (C) 0.1 to 10 parts by weight of an oil-soluble nitrogen compound containing a total of about 30 to 300 carbon atoms and selected from the class consisting of amine salts and/or amides of a $C_4$ to $C_{30}$ hydrocarbyl carboxylic acid or anhydride having 1 to 4 carbonyl groups, said compound having at least one straight chain alkyl segment of 8 to 40 carbon atoms.

14. An additive concentrate according to claim 13, wherein said ethylene distillate flow improving polymer (A) is a copolymer comprising principally 4 to 20 molar proportions of ethylene and a molar proportion of unsaturated ester of the general formula:

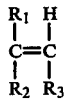

wherein $R_1$ is hydrogen or methyl; $R_2$ is a —$OOCR_4$ or —$COOR_4$ group; $R_3$ is hydrogen or —$COOR_4$; and $R_4$ is hydrogen or a $C_1$ to $C_{28}$ alkyl group, said copolymer having a number average molecular weight in the range of about 800 to 20,000.

15. An additive concentrate according to claim 14, wherein said second polymer (B) is a lubricating oil pour point depressant and is selected from the group consisting of copolymers of vinyl acetate and dialkyl fumarate, polymers comprising alkyl methacrylate or alkyl acrylate moieties, and esterified copolymers of $C_8$ to $C_{32}$ alpha monoolefin and maleic anhydride.

16. An additive concentrate according to claim 15, wherein said nitrogen compound (C) is a $C_4$ dicarboxylic acid or anhydride reacted with secondary alkyl monoamine having alkyl groups essentially of 14 to 18 carbon atoms.

17. An additive concentrate according to claim 16, wherein said ethylene backbone distillate flow improving polymer (A) is a copolymer of ethylene and vinyl acetate and said nitrogen compound (C) is an amine salt of maleic monoamide having a structure

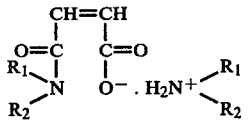

wherein $R_1$ and $R_2$ are the same or different and represent hydrogen or an alkyl group ranging from about 14 to 18 carbons.

18. An additive concentrate according to claim 15, wherein said nitrogen compound (C) is a phthalic acid or anhydride reacted with secondary alkyl monoamine having alkyl groups essentially of 14 to 18 carbon atoms.

19. A method for improving a distillate fuel oil by adding a minor proportion of said additive concentrate of claim 13.

* * * * *